US005425187A

United States Patent [19]

Artusi et al.

[11] Patent Number: 5,425,187

[45] Date of Patent: Jun. 20, 1995

[54] SKI BOOT WITH A LOCKING DEVICE

[75] Inventors: Giovanni Artusi, Pianiga; Stelio Simonetti, Noale, both of Italy

[73] Assignee: Lange International S.A., Fribourg, Switzerland

[21] Appl. No.: 194,120

[22] Filed: Feb. 9, 1994

Related U.S. Application Data

[63] Continuation of Ser. No. 10,411, Jan. 28, 1993, abandoned.

[30] Foreign Application Priority Data

Jan. 29, 1992 [CH] Switzerland ..... 251/92

[51] Int. Cl.[6] ..... A43B 5/04

[52] U.S. Cl. ..... 36/117; 36/50.5

[58] Field of Search ..... 36/117–121, 36/50.5; 24/68 SK, 69 SK, 70 SK, 71 SK

[56] References Cited

U.S. PATENT DOCUMENTS

| | | | |
|---|---|---|---|
| 4,037,333 | 7/1977 | Olivieri | 36/50.5 X |
| 4,104,766 | 8/1978 | Salomon | 36/50.5 X |
| 4,480,395 | 11/1984 | Schoch | 36/50.5 |
| 4,499,676 | 2/1985 | Chalmers | 36/120 |
| 4,510,703 | 4/1985 | Eiteljorg | 36/119 |
| 4,619,057 | 10/1986 | Sartor et al. | 36/120 X |
| 4,631,839 | 12/1986 | Bonetti et al. | 36/117 X |
| 4,653,204 | 3/1987 | Morell et al. | 36/50.5 X |
| 4,680,878 | 7/1987 | Pozzobon et al. | 36/50.5 X |
| 4,691,454 | 9/1987 | Ottieri | 36/117 |
| 4,756,099 | 7/1988 | Walkhoff | 36/50.5 X |
| 4,882,857 | 11/1989 | Sartor et al. | 36/50.5 x |
| 4,885,850 | 12/1989 | Sartor et al. | 36/50.5 X |
| 4,910,888 | 3/1990 | Perrissoud | 36/117 |
| 4,984,375 | 1/1991 | Bonnet | 36/119 |
| 5,003,710 | 4/1991 | Pozzobon | 36/117 |
| 5,054,214 | 10/1991 | Sartor | 36/117 X |
| 5,101,582 | 4/1992 | Pozzobon | 36/117 |
| 5,243,774 | 9/1993 | Mattiuzzo | 36/117 |

FOREIGN PATENT DOCUMENTS

| | | | |
|---|---|---|---|
| 2564711 | 11/1985 | France | 36/119 |
| 2651648 | 8/1990 | France . | |
| 2043679 | 3/1972 | Germany | 36/50.5 |
| 3600436 | 7/1987 | Germany | 36/117 |

*Primary Examiner*—Jimmy G. Foster
*Assistant Examiner*—Ted Kavanaugh
*Attorney, Agent, or Firm*—Kane, Dalsimer, Sullivan, Kurucz, Levy, Eisele & Richard

[57] ABSTRACT

Ski boot with a variable-volume shell (1), the shaft of which, which is articulated on the lower shell, is constituted by a front part (5) equipped with flaps and by a rear part (11), these two parts coming to be applied edge to edge against one another in the closed position. The two parts of the shaft are moreover connected to one another by two flexible bands (23) which are capable of being locked on the rear part (11) by a locking device (26), this device preferably being unlockable by the buckle (17) intended for clamping the shaft around the leg.

14 Claims, 10 Drawing Sheets

FIG. 4
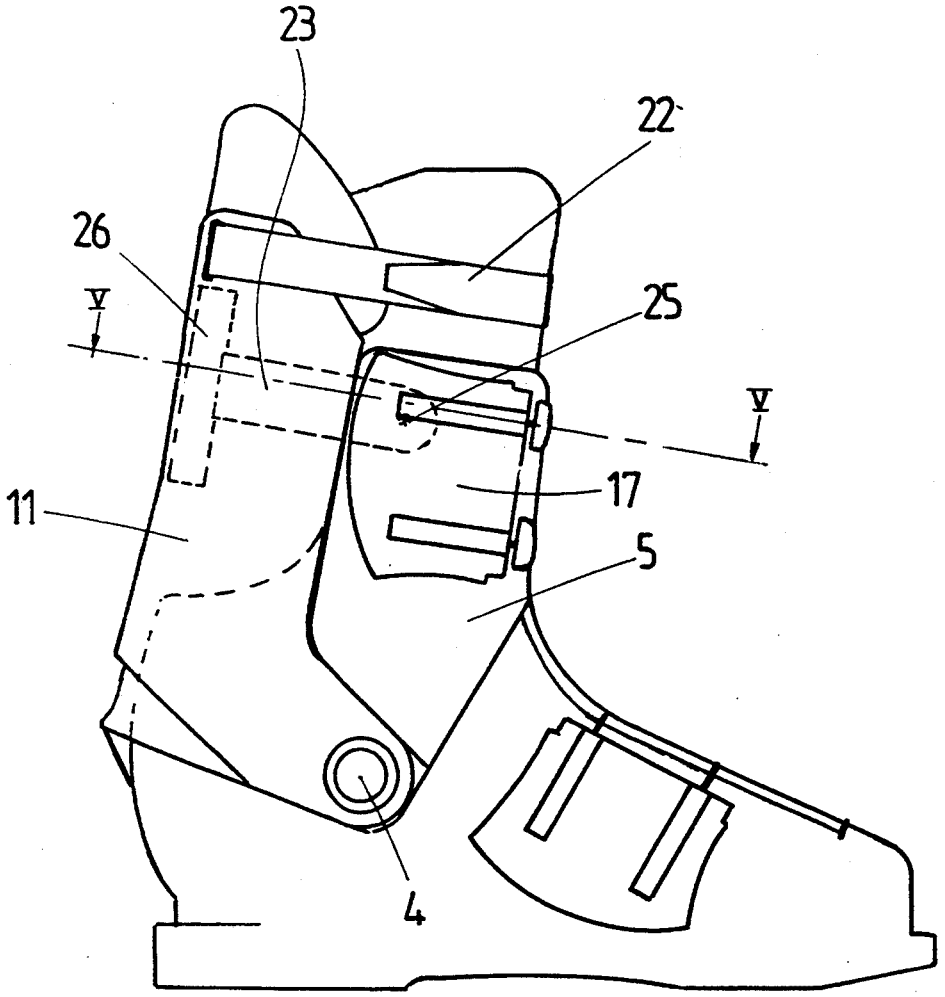
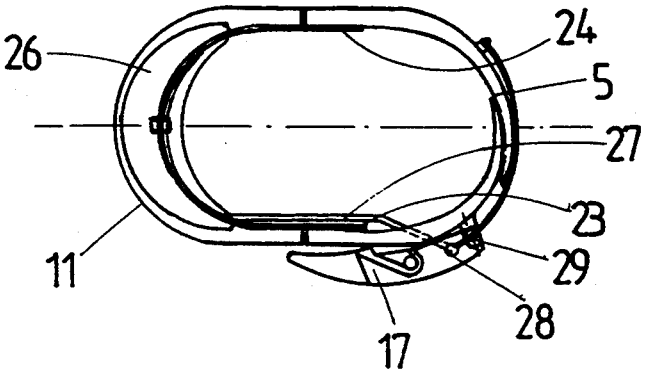
FIG. 5
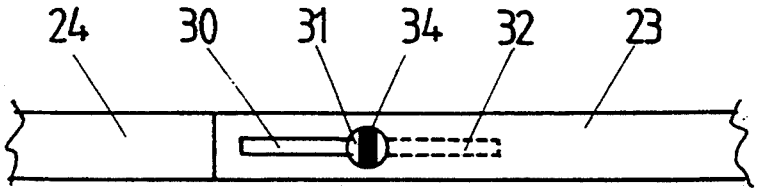
FIG. 6

FIG. 7
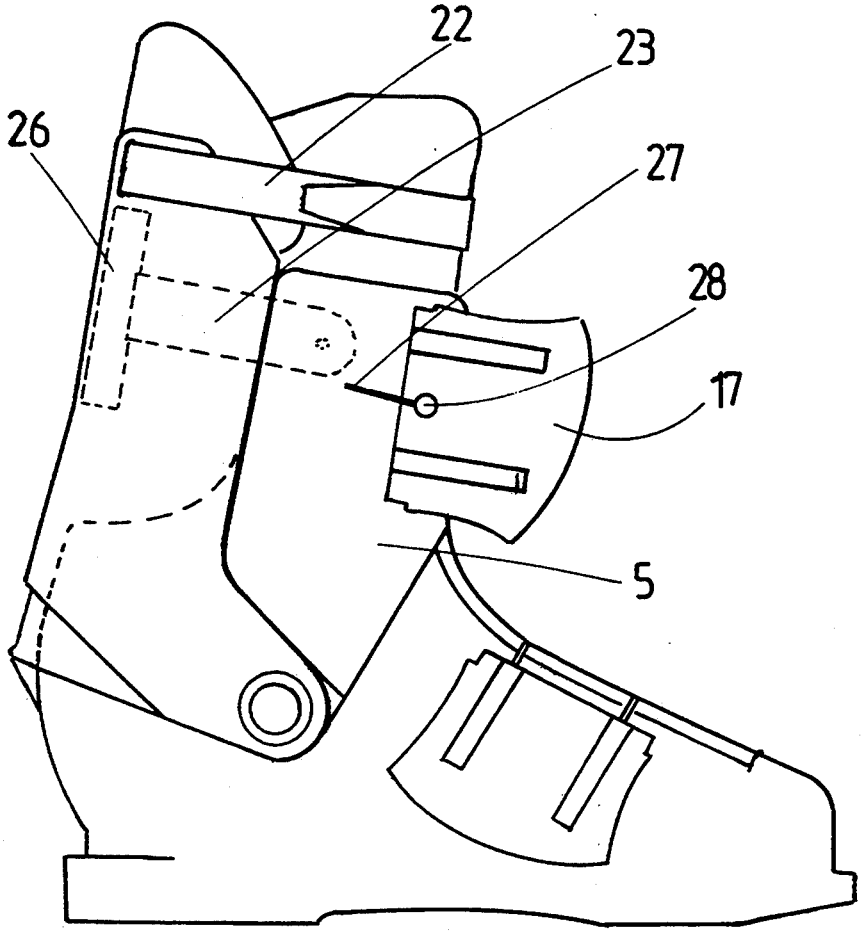
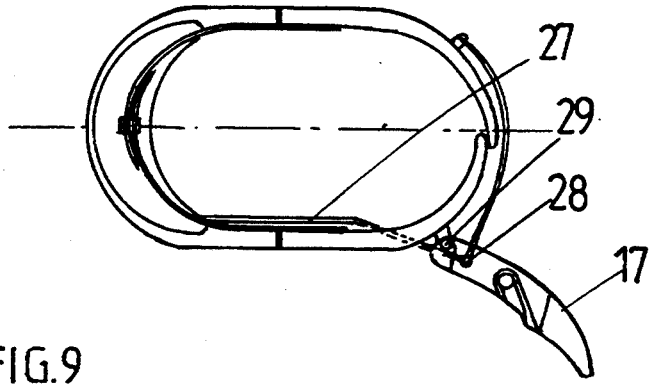
FIG. 8
FIG. 9
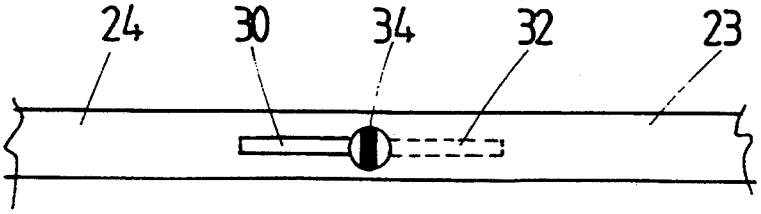

FIG. 10
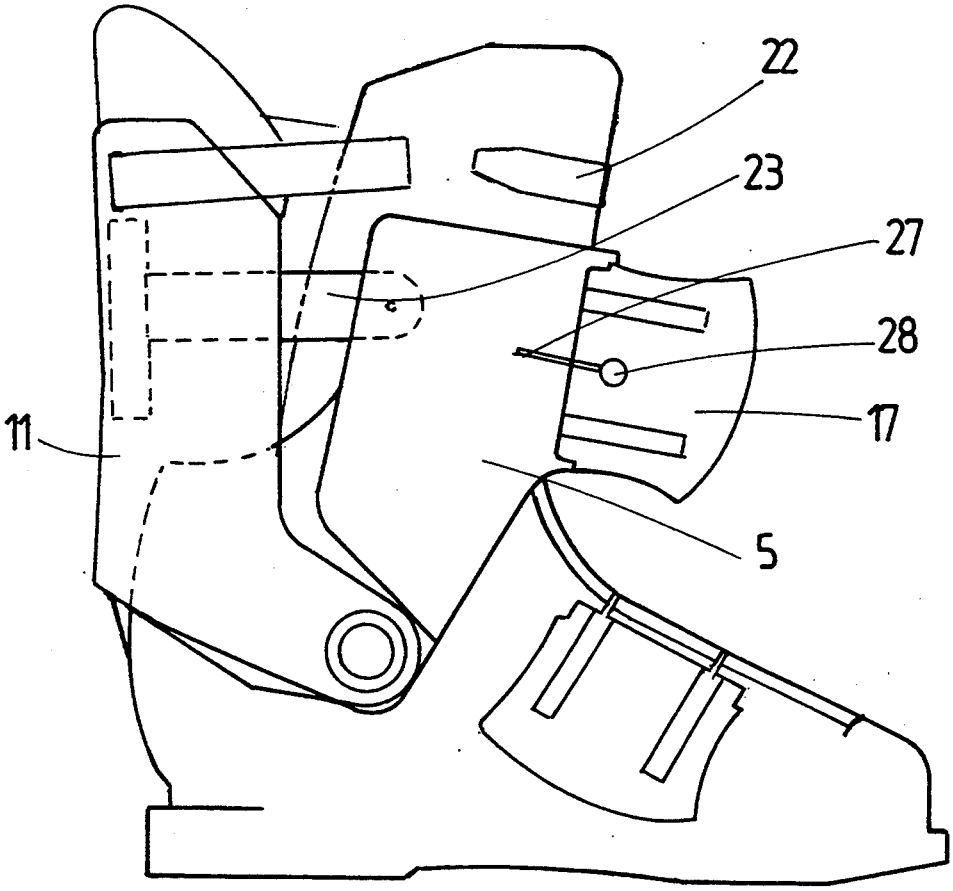
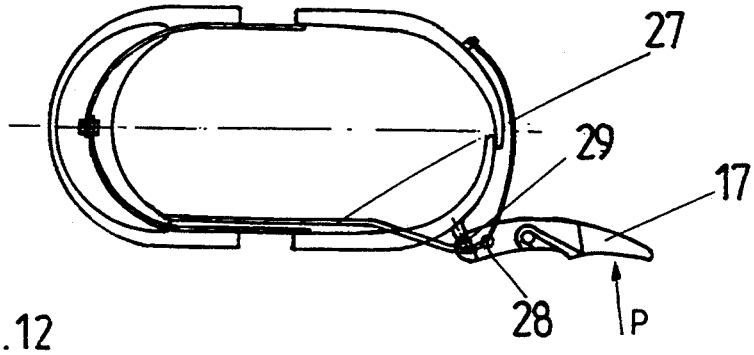
FIG. 11
FIG. 12
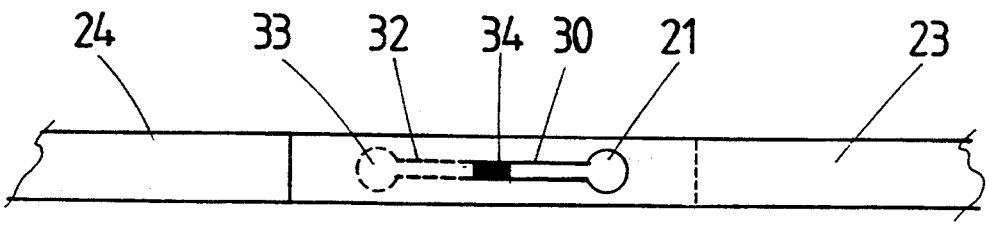

FIG. 16
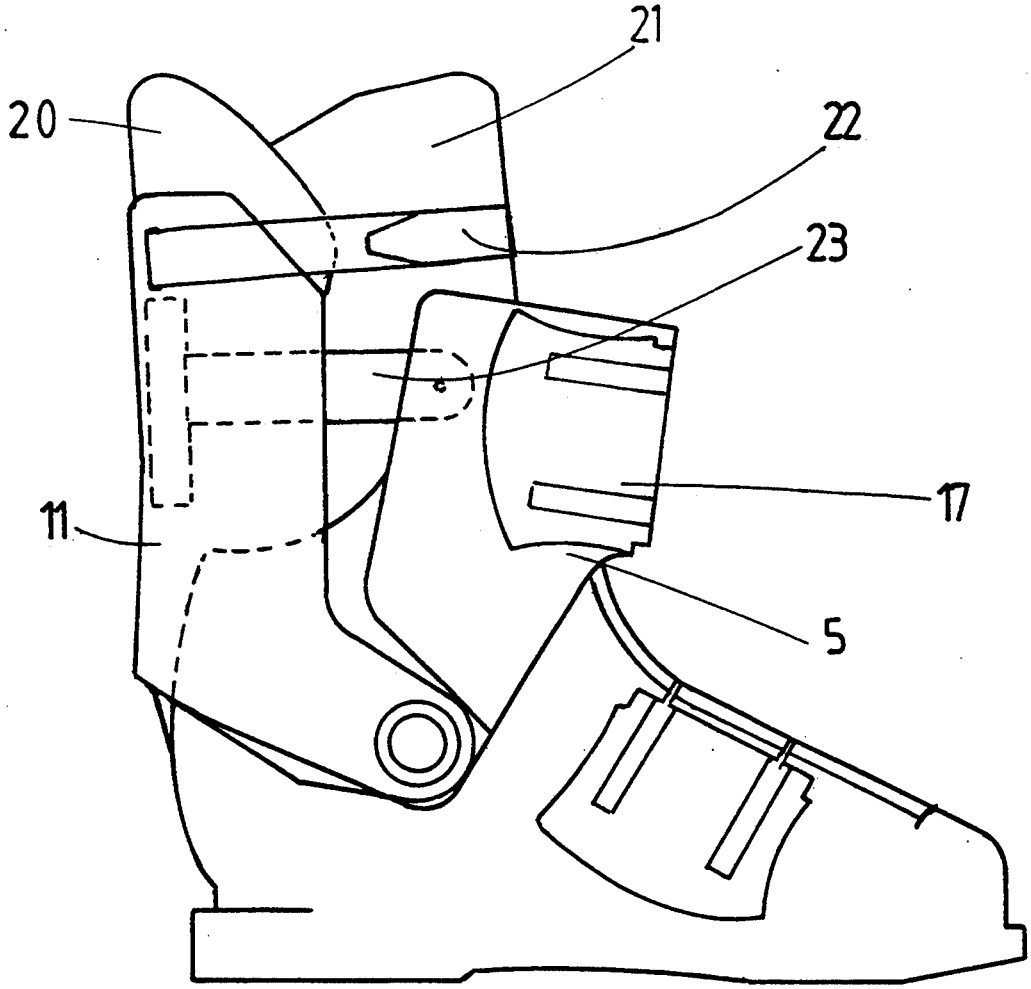
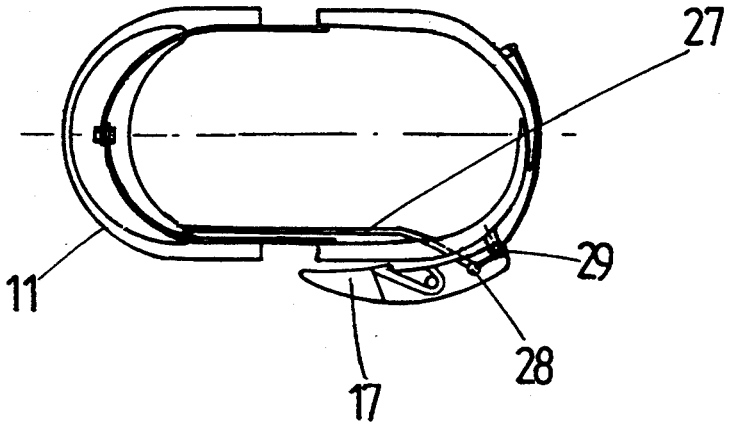
FIG. 17

SKI BOOT WITH A LOCKING DEVICE

This application is a continuation of application Ser. No. 08/010,411 filed Jan. 28, 1993, now abandoned.

FIELD OF THE INVENTION

The present invention relates to a ski boot with a shell comprising a variable-volume lower shell intended to surround the foot and the heel and a shaft articulated on the lower shell and constituted by a front part and by a rear part which are articulated about a common pin and come to be applied edge to edge against one another in the closed position, the front part forming a collar having at the front two superposed flaps which make possible the clamping of the shaft and at the rear an indentation intended to be closed by the rear part, the boot being provided with at least one buckle for clamping the shaft, and at least one buckle for clamping the lower shell on the foot.

PRIOR ART

A boot of this type is described in U.S. Pat. No. 5,243,774. Such a boot combines the advantages of rear-entry boots and those of boots with a shaft in one piece in the form of a collar. The shaft can in effect be opened wide so as to facilitate putting on and removing the boot while, once closed, the shaft acts like a single collar articulated on the boot, allowing tipping forwards and ensuring under all circumstances good holding of the foot and good steering of the ski. The two parts of the shaft, which open and close like a box, are kept closed by means of a special buckle mounted on the rear part and equipped with a catch which interacts with a serrated belt attached to the front part. By opening the buckle mounted on the rear part, without, however, releasing the catch from the toothing of the serrated belt, a play is created in the closing of the two parts of the shaft, which play makes possible relaxation without loss of adjustment of the clamping of the shaft around the leg. Complete opening of the shaft is effected by releasing the catch from the toothing of the serrated belt.

SUMMARY OF THE INVENTION

The aim of the present invention is to eliminate the external buckle for closing the shaft and to simplify the use of the boot while retaining, of course, an intermediate relaxation position.

To this end, the boot according to the invention is characterized in that the two parts of the shaft are connected to one another by two flexible bands attached by one of their ends respectively on each side of the front part of the shaft and connected to the rear part of the shaft by a lockable device which allows the relative displacement of the flexible bands in the unlocked position. The flexible bands are preferably made of metal, particularly steel, but they could also be made of synthetic or mineral material such as carbon fibers.

The flexible bands, as well as the means for locking and for unlocking, are preferably inside the shaft, that is to say completely hidden in the closed and the relaxation position, which eliminates any external projection on the rear part of the shaft and makes it possible to obtain a particularly aesthetic boot. Moreover, the means for unlocking are preferably actuated, via a cable, by means of a buckle for closing and clamping the front part of the shaft. In this case, a first mode of relaxation takes place in the region of the front part of the shaft by opening the buckle or the buckles closing this part. Unlocking of the metal bands is effected by exerting an additional traction on the unlocking cable by means of the corresponding closing buckle. The boot is open and the skier can remove it. In this position, it is possible to reclose the band of the shaft, which leads to a second relaxation or walking position.

The return into locking position of the flexible metal bands can be brought about easily by means of a catching device actuated by a spring, so that the closing of the two parts of the shaft automatically causes the locking of the two metal bands.

BRIEF DESCRIPTION OF THE DRAWINGS

The attached drawing shows by way of example an embodiment of the boot according to the invention, as well as a number of embodiments of the device for locking the flexible bands.

FIG. 4 is a view of the boot shown in FIG. 1, in the closed and clamped position.

FIG. 5 is a diagrammatic view in horizontal section along V—V in FIG. 4.

FIG. 6 shows diagrammatically the means for locking the metal bands in the locked position.

FIG. 7 is a similar view of the same boot in a first relaxation position.

FIG. 8 is a view similar to FIG. 5 in the first relaxation position.

FIG. 9 shows the state of the locking means in the same relaxation position.

FIG. 10 is a similar view of the same boot in the open position for putting on or removing the boot.

FIG. 11 is a view similar to FIG. 5 in the open position.

FIG. 12 shows the metal bands in the unlocked position.

FIG. 16 shows the same boot in a second relaxation position.

FIG. 17 is a view in section similar to FIG. 5 in the second relaxation position.

DESCRIPTION OF THE PREFERRED EMBODIMENTS

Figure 1:
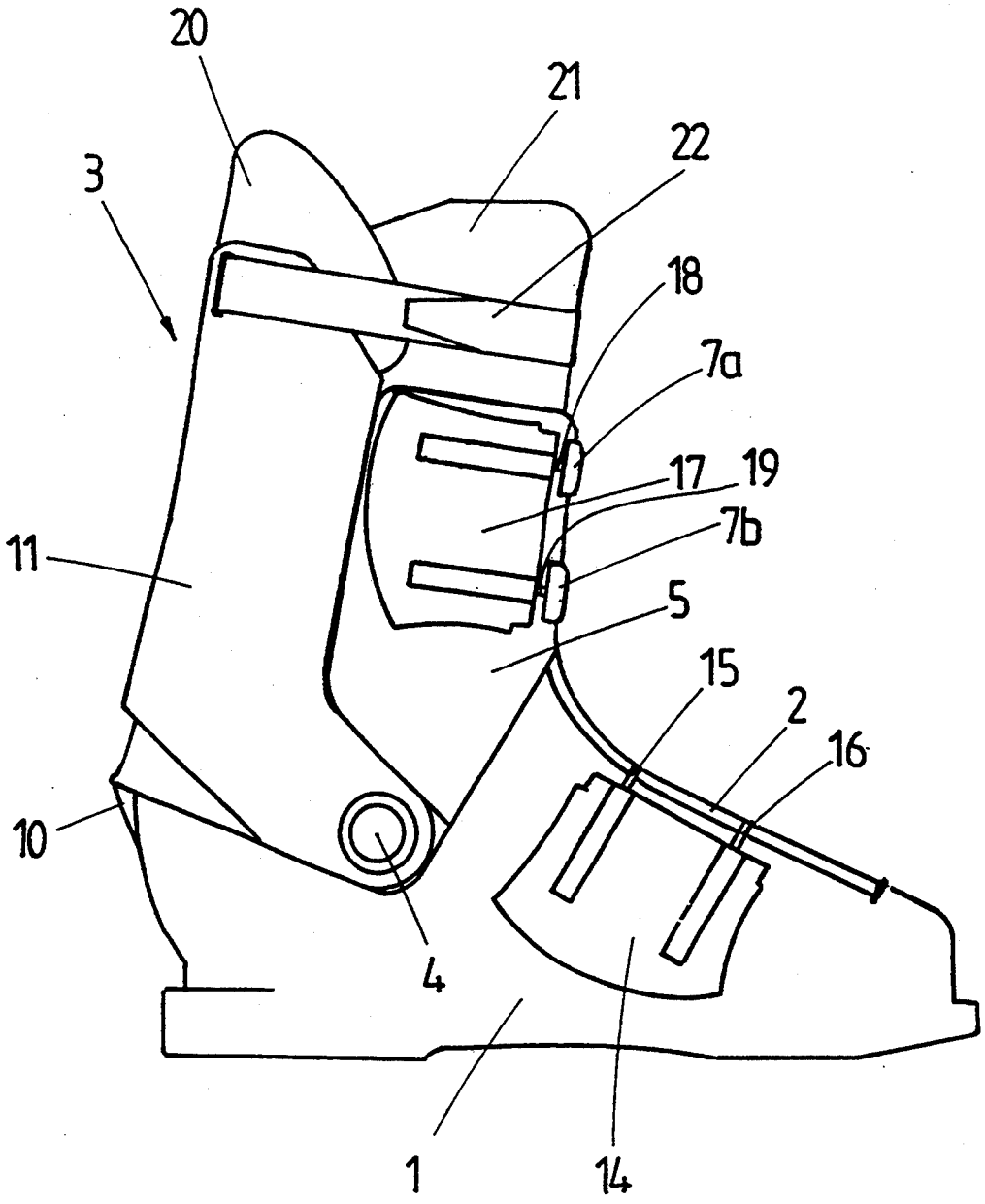
FIG. 1 shows the boot in the closed position.
Figures 2, 3:
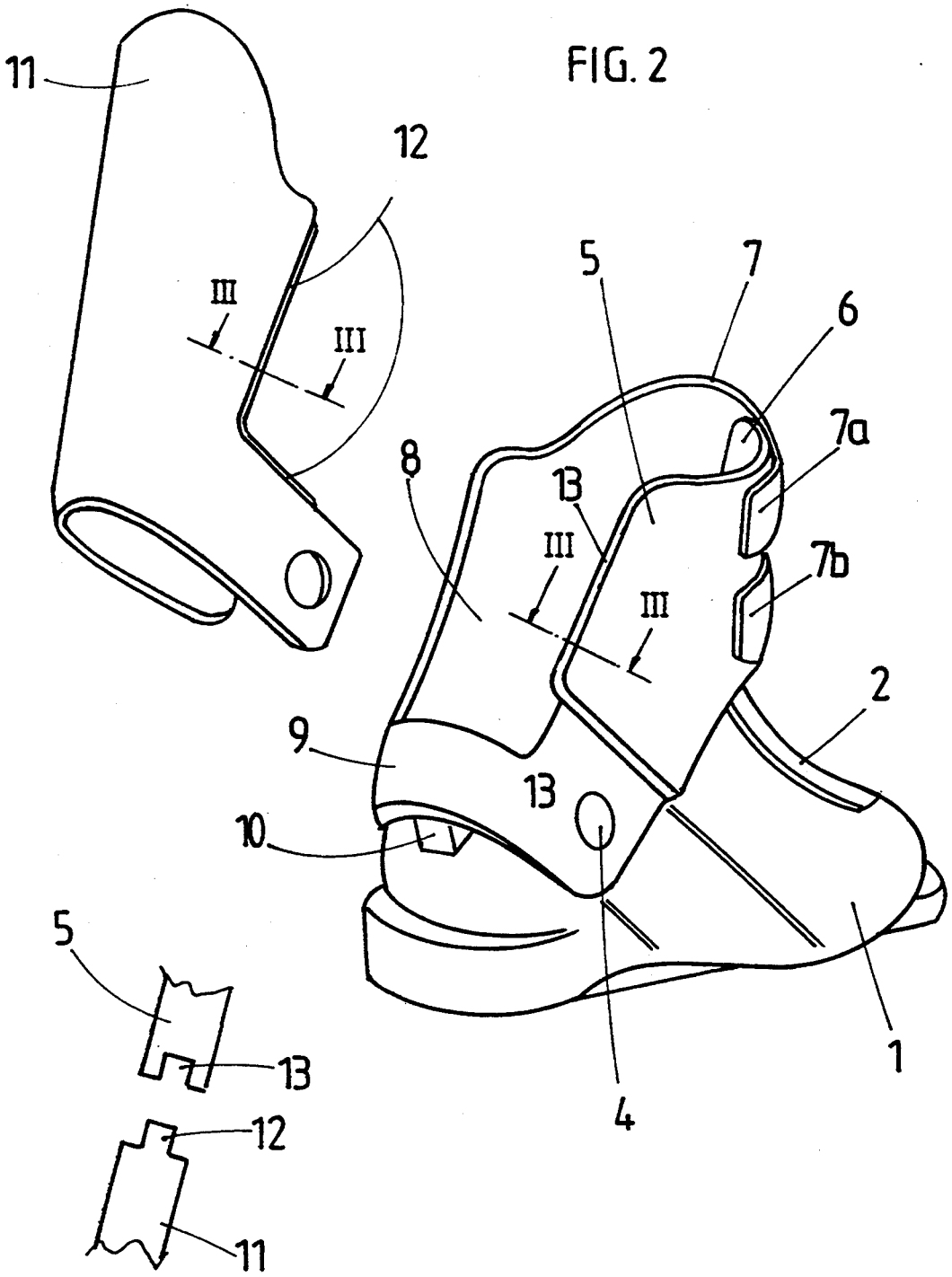
FIG. 2 shows the constituent parts of the shell of the boot without the flexible bands.
FIG. 3 is a detailed view in section along III—III in FIG. 2.

The boot shown in FIGS. 1 to 3 is of the type described in the Patent Application FR 91 02521. It comprises a variable-volume lower shell which surrounds the foot and the heel and closes on the foot via two flaps 2. Articulated on the lower shell 1, at the level of the ankles, is a shaft 3. In practice, the articulation is formed by rivets 4. The shaft 3 consists of two parts articulated at 4, that is to say a front part 5 in the form of a collar which closes on the front of the leg via two flaps 6 and 7 and has at the rear a deep indentation 8 with rectilinear sides, allowing a bridge 9 to remain, the lower edge of which comes to abut against a stop 10 formed on the lower shell 1 at the level of the calcaneum in order to keep the front part 5 of the shaft in a position slightly inclined towards the front, and a rear part 11 in the form of a rounded cap which is likewise articulated at 4 and comes to close the indentation 8 of the front part. The parts 5 and 11 of the shaft come to close edge to edge via a set of tenons 12 and mortises 13 formed respectively on the part 11 and on the part 5 so as to ensure stable and impermeable closing of the shaft. The two parts 5 and 11 are kept together by means which will be described below.

The lower shell 1 can be clamped by means of a single buckle 14 which pulls on two cables 15 and 16 connected to the upper flap 2, while the shaft can be clamped by means of a second single buckle 17 which acts on two cables 18 and 19 fixed respectively to the two tabs *7a* and *7b* of the flap 7. The cables are attached to the buckles by any known means, for example by means of threaded studs fixed to the cables and screwed into knurled bushes which are integral with the buckles and make possible the adjustment and storage of the clamping force.

In FIG. 1, the usual rear padding 20 which is integral with the cap 11 and the protruding part 21 of the inner comfort boot can also be seen. In a known manner, the parts 20 and 21 can be independent or together form a removable inner boot. In the upper part of the cap 11, there is moreover fixed a belt 22 which comes to surround the leg in the region of the part 21 of the inner boot. The belt 22 can be closed by any means, preferably by means of "VELCRO" (registered trade mark) bands.

The two parts 5 and 11 of the shaft are kept closed by two flat flexible metal bands 23 and 24, for example made of steel, arranged inside the shaft (FIGS. 4 to 6). The band 23 is fixed on one side of the front part 5 of the shaft by means of a rivet 25 while the other metal band 24 is fixed in a similar manner on the opposite side of this front part 5. At the rear, the two metal bands 23 and 24 are superposed in a mutual locking device 26 fixed to the cap 11. The locking device 26 comprises unlocking means controlled by a cable 27 attached at a point 28 of the buckle 17 at a short distance from the articulation pin 29 of this buckle on the boot.

In the locking device 26, the metal bands 23 and 24 are superposed and guided. In the zone of superposition, the band 23 has a longitudinal slit 30 with edges which are parallel and open into a circular cutout 31 which has a diameter which is essentially greater than the width of the slit 30, and is situated at the end of the slit 30 opposite the end of the band 23. The metal band 24 has a similar slit 32 which likewise opens into a circular cutout 33 (FIG. 12) of the same diameter as the cutout 31. When the cutouts 31 and 33 are superposed, the two metal bands 23 and 24 can be locked together by a bar 34 constituted by a piece or by a piece part of essentially rectangular shape of a width which is slightly smaller than the width of the slits 30 and 32 and of a length which is essentially equal to the diameter of the circular cutouts 31 and 33. When the cutouts 31 and 33 coincide (FIG. 6), the bar 34 can be arranged transversely to the bands and these are locked mutually, keeping the shaft of the boot closed.

When the buckle 17 is raised to unclamp the shaft of the boot, as shown in FIGS. 7 and 8, a traction is exerted on the unlocking cable 27, but at first without causing unlocking.

If, starting from this unclamped position, the buckle 17 continues to be displaced in the direction of the inside of the leg, the unlocking cable 27 then starts to wind up around the articulation pin 29 of the buckle 17 and the additional traction thus exerted on the cable 27 has the effect of making the bar 34 pivot by a quarter turn and of aligning it on the slits 30 and 32 of the metal bands, imparting to the latter a certain relative freedom, the simultaneous bearing of the leg against the cap 11 making the metal bands slide on one another until they arrive in abutment, via the ends of their slits, against the bar 34 as shown in FIG. 12. The shaft of the boot can then be open as shown in FIGS. 10 and 11.

Figure 13:
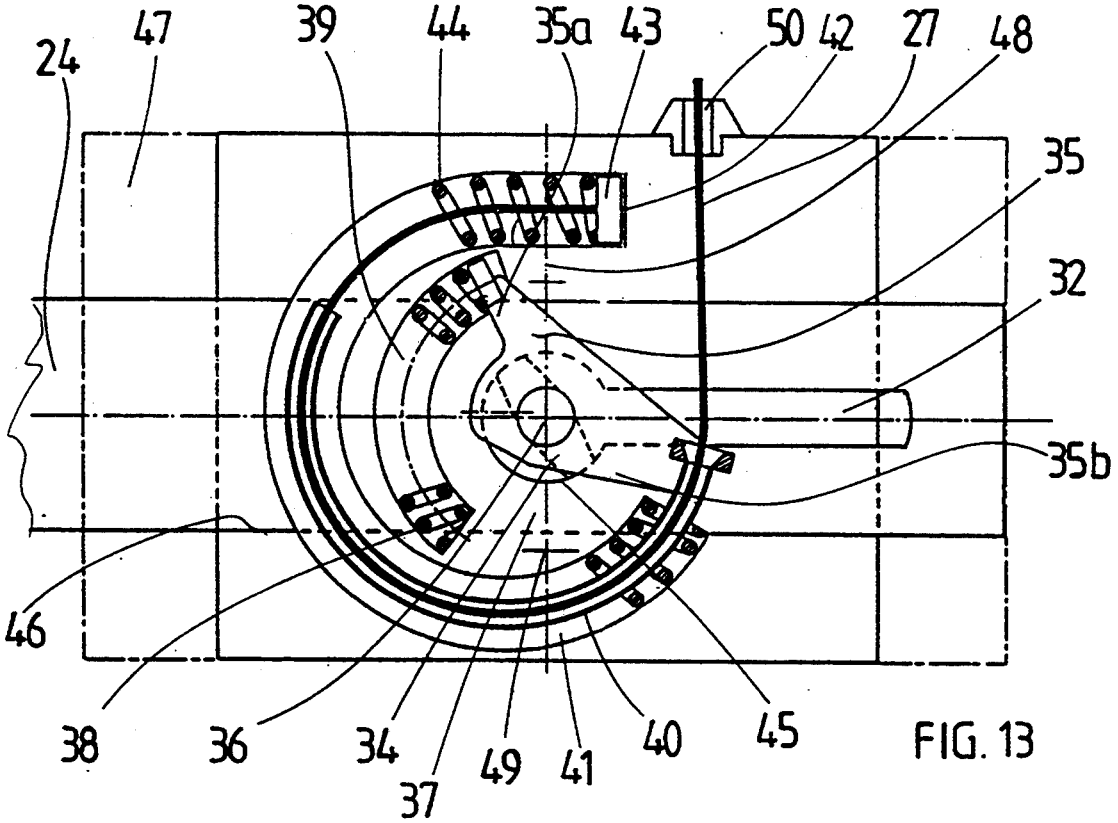
FIG. 13 shows, on a larger scale, the means for locking and for unlocking corresponding to FIGS. 6, 9 and 12 in the locked position.
Figure 14:
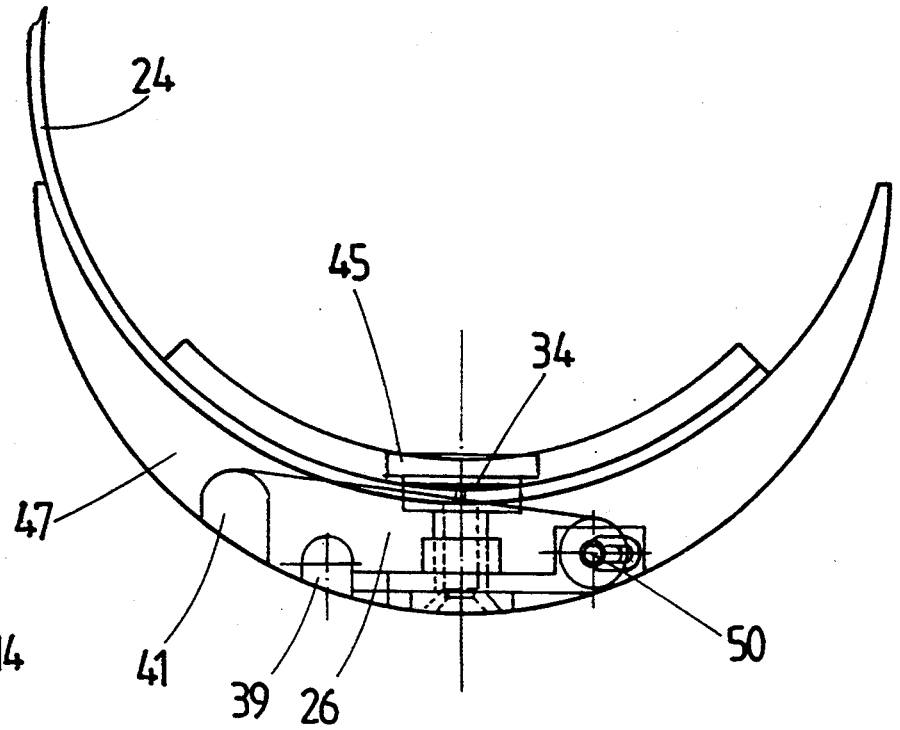
FIG. 14 is a top view of the locking zone shownin FIG. 13.
Figure 15:
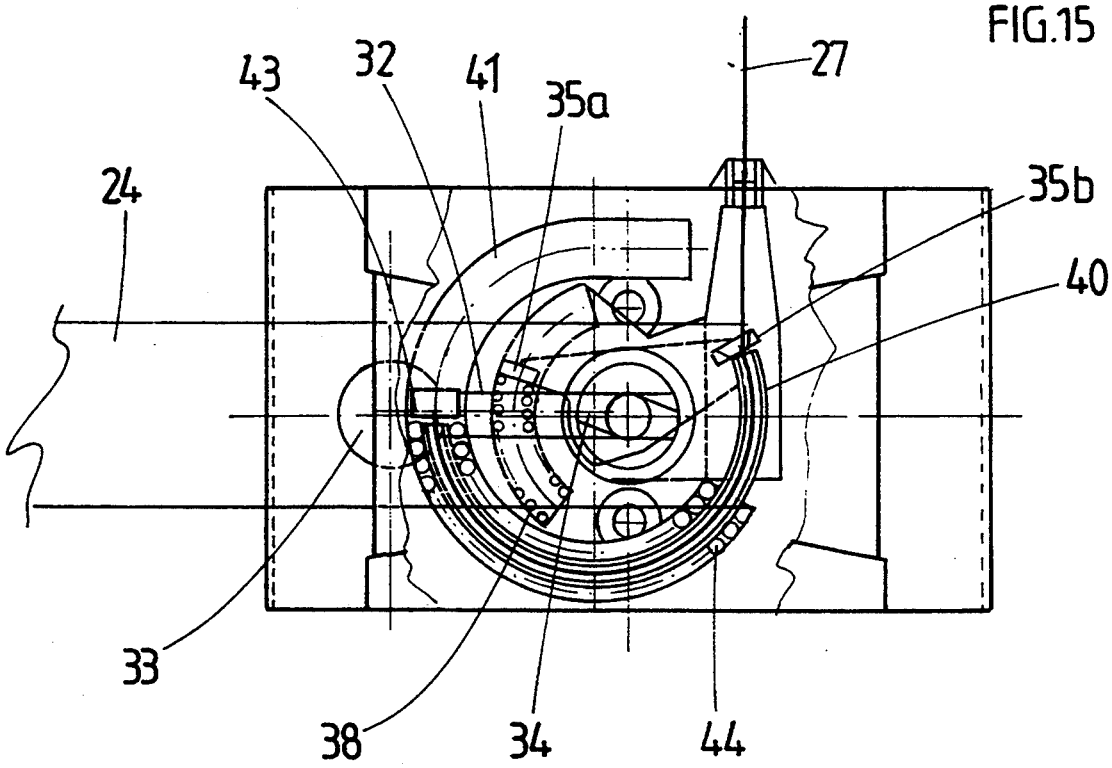
FIG. 15 shows the same locking means in the unlocked position.

An embodiment of the means for actuating the bar 34 is shown in FIGS. 13 to 15. To simplify the drawing, only the band 24 with its slit 32 has been shown. The bar 34, here in the form of a lozenge truncated by a circle, forms part of a lever 35 equipped with a pivot 36, by which it is pivoted in a frame 37, and with two arms 35a and 35b. The arm 35a is kept in abutment by a first helical spring 38 working under compression in a housing in the shape of a circular arc 39. Bearing against the arm 35b is the end of an arc-shaped, movable tube 40 which extends over a little more than a half-circle. This tube 40 is itself accommodated in a housing 41 which is longer than the tube 40. Whereas the housing 39 is centered on the pivot pin 36, the tube 40 and the housing 41 are moved out of center in relation to this pivot. The end 42 of the housing 41 opposite the lever is closed. The internal tube 40 is passed through by the cable 27, at the end of which a head 43 is fixed, against which bears a second helical spring 44 which surrounds the movable tube 40 and is slightly compressed between the cable head 43 and the other end of the tube 41 which has an opening which is just sufficient for the passage of the internal tube 40. The spring 38 is stronger than the spring 44 so that, in the absence of traction on the cable 27, the bar is kept in the locking position shown in FIG. 13.

On the internal side of the boot, the bar 34 is surmounted by a plate 45 which has a diameter greater than the diameter of the bar and is intended to retain the bands 23 and 24 on the lever 35. These are moreover guided laterally by a guide 46. The assembly is mounted on a profiled support 47 fixed at two points 48 and 49 to the rear cap 11. The cable 27 penetrates into the locking device via an entrance 50 equipped with a guide tube.

The initial traction exerted on the cable 27 during opening of the buckle 17 in the position shown in FIGS. 7 and 8 has the effect of compressing the spring 44 until the cable head 43 arrives in abutment against the end of the internal movable tube 40. This compression is insufficient for displacing the lever 35 retained by the spring 38. This first travel of the cable 27 is therefore without effect on the bar 34. A first relaxation position is thus obtained, in which the lower leg is unclamped at the front. Starting from this position, if an additional traction is exerted on the cable 27, as described with reference to FIGS. 10 and 11, the movable tube 40 is drawn by the cable head 43 and with it the lever 35 which pivots, compressing the spring 38. At the end of a certain travel, the bar 34 comes to be oriented in the direction of the slits 30 and 32 of the metal bands, allowing these to be displaced on one another as shown in FIG. 12. The boot can then open as shown in FIG. 10. It will be noted that no traction is exerted on the cable 27, given that it is kept in the stretched position by the bar itself. The rotation of the bar can be limited by a stop.

In this position, rear part 11 open towards the rear, the user can either open the belt 22 to put on or remove the boot, as shown in FIGS. 10 and 11, or keep the belt 22 closed and reclose the buckle 17, as shown in FIGS. 16 and 17, so as to obtain a second relaxation position, in which the user can straighten the leg and walk more easily, this although the buckle 17 is closed.

When putting the boot back on, the shaft can be reclosed, either by pushing the cap 11 towards the front, or by pulling the latter towards the front by means of the belt 22. During this movement of the cap 11, the metal bands 23 and 24 slide on one another and, once the two parts 5 and 11 of the shaft are again brought together, the circular cutouts 31 and 33 of the metal bands are again superposed and the bar 34 can pivot under the thrust of the spring 38, locking again the metal bands. The movable tube 40 again comes to occupy the position shown in FIG. 13. Closing the buckle 17 has the effect of bringing the cable head 43 back into the position shown in FIG. 13. Locking is thus effected automatically during closing of the shaft.

Figure 18:
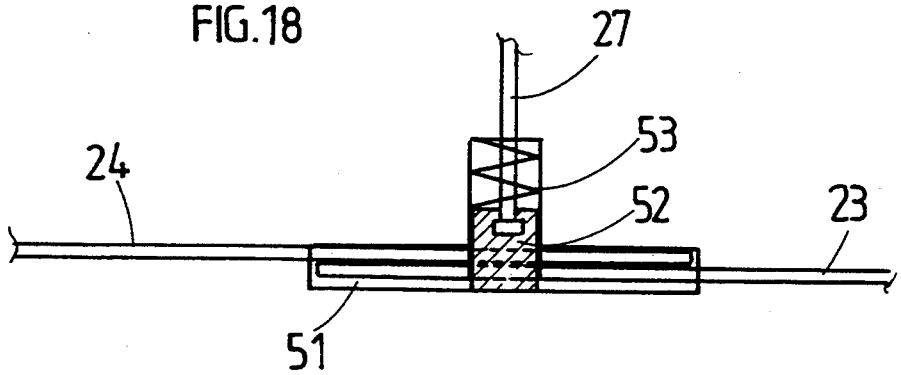
FIG. 18 shows diagrammatically a second embodiment of the locking means.
Figure 19:
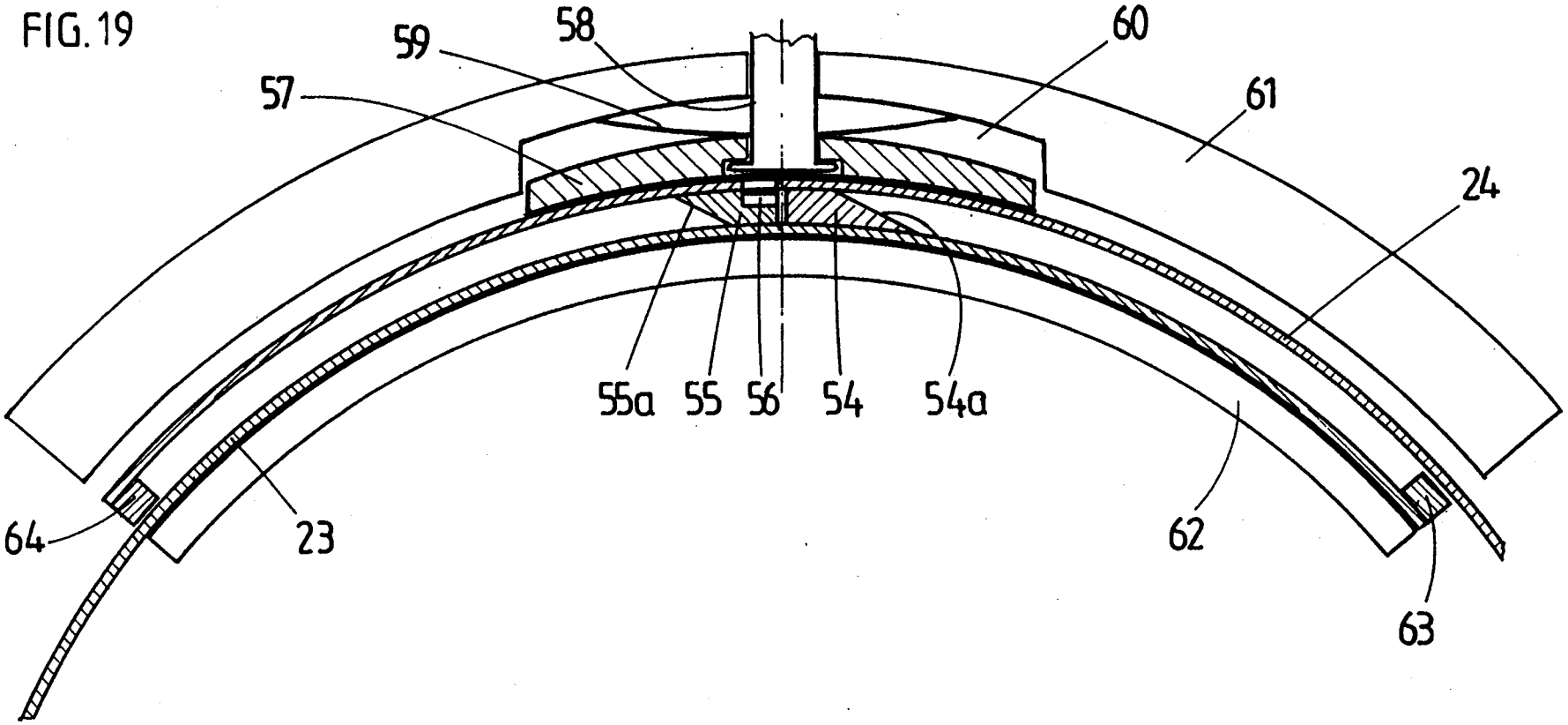
FIG. 19 shows diagrammatically a third embodiment of the locking means.

The mutual locking of the metal bands can be effected in various ways. A second embodiment is shown diagrammatically in FIG. 18. In their zone of superposition, the metal bands 23 and 24 are guided in a sleeve 51. They each simply have a circular hole, holes in which a bar 52 in the form of a finger engages under the thrust of a spring 53. Unlocking takes place simply by traction on the finger 52 by the cable 27. Displacement of the bands 23 and 24 is limited by stop means, for example by enlargements provided at the ends of the strips coming to abut against stops at the ends of the sleeve 51. Locking is again carried out automatically when the holes of the bands coincide.

The metal bands 23 and 24 can also be locked by mutual hooking. The following figures show two embodiments working by hooking.

According to a third embodiment shown in FIG. 9, the band 23 is equipped with a projection 54 which comes to be hooked on a similar projection 55 of the band 24. These projections come to be hooked on one another by flanks perpendicular to the bands, the opposite sides of the projections being in the form of a ramp 54a and 55*a* respectively. The projections 54 and 55 do not extend over the entire width of the bands, so that the band 24 can be gripped on each side of its projection 55 by a hook 56 which is integral with a guide shoe 57 which itself is integral with a pull 58, on which the cable 27 acts via a lever mechanism which can comprise a compensation device with neutral travel as in the case of FIG. 15. The shoe 57 is pushed against the bands by a leaf spring 59 mounted in a housing 60 arranged in a support piece 61 fixed to the cap 11. On the internal side of the boot, the metal bands 23 and 24 are guided by a guide piece 62. To liberate the metal bands 23 and 24, it is only necessary to pull the shoe 57 backwards into its housing 60, compressing the spring 59, so that the projection 55 can pass over the projection 54. During closing of the boot, the projections 54 and 55 slide on one another via their ramp 54*a* and 55*a*, pushing back the shoe 57 to fall back into the hooked position.

The travel of the unlocked metal bands 23 and 24 is limited by studs 63 and 64 fixed to the ends of the strips.

Figure 20:
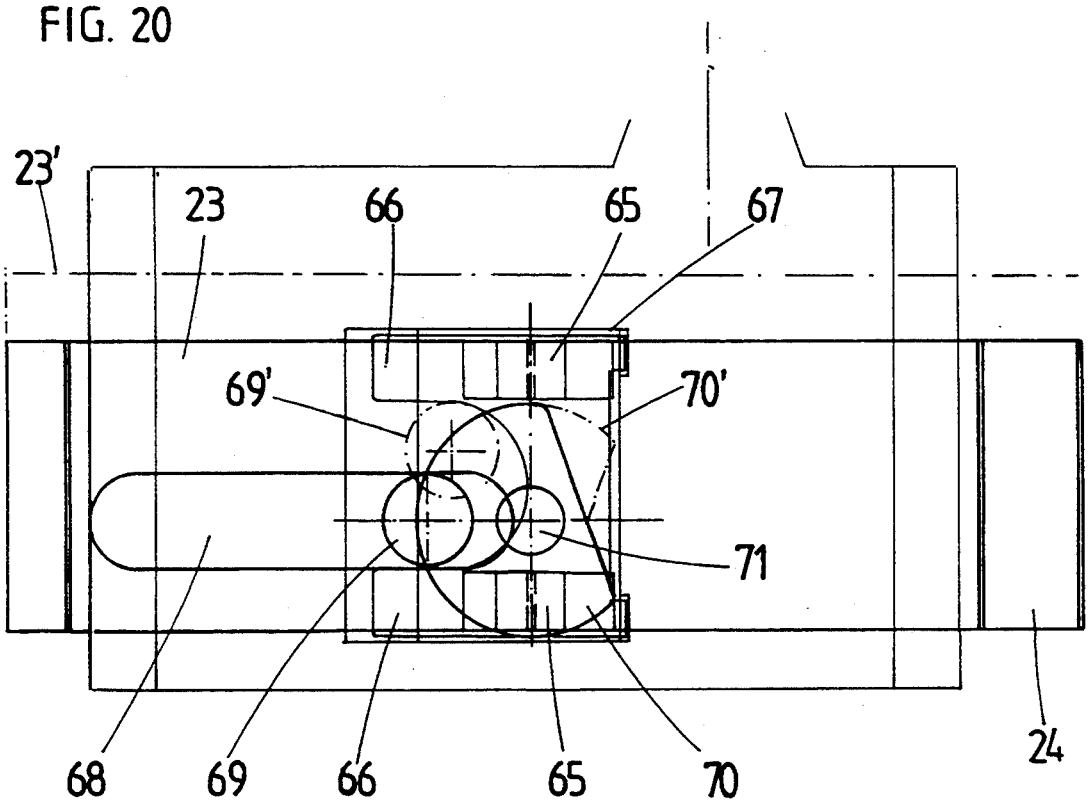
FIGS. 20 and 21 show diagrammatically a fourth embodiment of the locking means.
Figure 21:
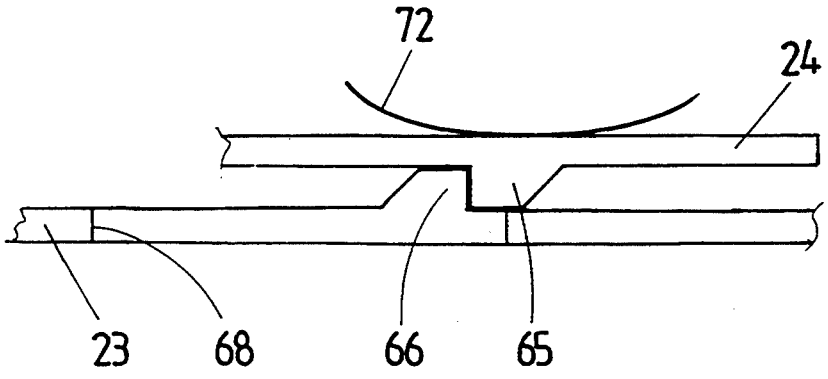

A fourth embodiment of the locking is shown in FIGS. 20 and 21. The bands 23 and 24 are again hooked mutually by projections 65 and 66 which have profiles similar to those of the projections 54 and 55 but extend only along the edges of the bands, that is to say they take the form of a pair of projections. One of the metal bands, for example the band 24, is guided laterally on each side by a guide 67. On the other hand, the metal band 23 can be displaced laterally, but it has a longitudinal slot 68, in which is engaged a cylindrical stud 69 of a crank pin 70 equipped with a pivot 71. The metal band 23 is therefore held laterally by the stud 69. To unhook the metal bands from one another, it is only necessary to drive the crank pin 70 rotationally, as shown in dot/-dash lines in the position 70', which has the effect of displacing the band 23 laterally into the position 23' in relation to the band 24. The projections 65 and 66 no longer face one another and the bands can slidee on one another longitudinally. A return spring then brings the crank pin 70 back into the position shown in solid lines. During closing of the boot, the projections 65 and 66 pass on top of one another, compressing a spring 72, to come to be hooked again as shown in FIG. 21.

The metal bands or strips could be unlocked by a means other than a cable such as the cable 27. In particular, the bar, whatever its form, could be actuated directly by hand via a button, a lever or a pull mounted on the back of the cap 11.

Instead of being arranged inside the boot, the metal strips or bands could be fixed on the outside of the boot.

Instead of being superposed, the flexible bands could be arranged side by side and have lateral notches or lateral hooks. One of the bands could have a longitudinal slit, in which the other band engages. In a general manner, the invention can be implemented by any means of locking which makes it possible to lock the bands in a closed position.

We claim:

1. A ski boot with a shell comprising a variable-volume lower shell (1) intended to surround a foot and a heel of a skier and a shaft (3) articulated on the lower shell and constituted by a front part (5) having an inner and outer side and a rear edge (13) and by a rear part (11) having an inner and outer side and a front edge (12) which are articulated about a common pin (4) between a closed position and an open position, in the closed position the rear edge of said front part abutting the front edge of said rear part, the front part (5) forming a collar having at the front two superposed flaps which make possible the clamping of the shaft and at the rear an indentation (8) intended to be closed by the rear part (11), the boot being provided with at least one buckle (17) for clamping the shaft, and at least one buckle (14) for clamping the lower shell on the foot, wherein the two parts of the shaft (5, 11) are connected to one another by two non-extensible, free of tension, flexible flat bands (23, 24) adapted to assume a locking position and an unlocked position, the bands attached by one of their ends respectively on each side of the front part of the shaft and connected to the rear part of the shaft by a lockable device (34; 52, 54, 55, 65, 66) which allows the relative displacement of the flexible bands in the unlocked position whereby the front part and rear part are adapted to assume a locked position at which the rear edge of said front part is locked in the abutting relation with the front edge of said rear part and an unlocked position at which the edges are displaced from one another, respectively.

2. The ski boot as claimed in claim 1, wherein the lockable device being so constructed and arranged to lock automatically when the flexible bands are in the locking position.

3. The ski boot as claimed in claim 2, which comprises an unlocking device constituted by a cable (27) actuated by the buckle (17) mounted on the shaft.

4. The ski boot as claimed in claim 3, wherein said cable (27) is attached to the buckle (17) for clamping and unclamping the shaft.

5. The ski boot as claimed in claim 4, wherein the buckle (17), to which the cable is attached, is so constructed and arranged to articulate on the boot in such a manner that, during its opening, it can pass the unclamped position of the shaft, winding up the cable (27) around its articulation pin (29) so that an additional traction is exerted on the cable, this additional traction ensuring the unlocking of the flexible strips.

6. A ski boot with a shell comprising a variable-volume lower shell (1) intended to surround a foot and a heel of a skier and a shaft (3) articulated on the lower shell and constituted by a front part (5) and by a rear part (11) which are articulated about a common pin (4) between a closed position and an open position and come to be applied edge to edge against one another in the closed position, the front part (5) forming a collar having at the front two superposed flaps which make possible the clamping of the shaft and at the rear an indentation (8) intended to be closed by the rear part (11), the boot being provided with at least one buckle (17) for clamping the shaft, and at least one buckle (14) for clamping the lower shell on the foot, wherein the two parts of the shaft (5,11) are connected to one another by two non-extensible flexible bands (23, 24) adapted to assume a locking position and an unlocked position, the bands attached by one of their ends respectively on each side of the front part of the shaft and connected to the rear part of the shaft by a lockable device (34; 52; 54, 55; 65, 66) which allows the relative displacement of the flexible bands in the unlocked position; wherein said lockable device is constructed and arranged to lock automatically when the flexible bands are in the locking position; wherein the flexible bands (23, 24) are superposed and have, in their zone of superposition, a longitudinal slit (30, 32) with edges which are parallel and open, at one end, into a circular cutout (31, 33) which has a diameter which is greater than the width of the slits, these slits being passed through by a rotary bar (34) of a width which is smaller than the width of the slits and of a length which is equal to the diameter of the circular cutouts so that, when the bar is oriented parallel to the slits, the two flexible bands can slide on one another while, when the bar is oriented transversely to the slits, in the circular cutouts, the flexible bands are locked.

7. The ski boot as claimed in claim 6, comprising unlocking means comprising a cable equipped with a head (43) at its end and attached at its other end to the buckle (17) for clamping the shaft, wherein the rotary bar (34) having a locking position and an unlocked position is integral with a lever (35) with two arms, one (35*a*) of which is subjected to the action of a first return spring (38) which tends to keep the bar in its locking position and wherein the unlocking device comprise a tubular housing (41), in which there is mounted a movable tube (40) which is passed through by the cable (27) and one end of which bears against the other arm (35*b*) of said lever, and a second return sprint (44) which tends to keep the cable head at a certain distance from the other end of the movable tube, a distance corresponding to the travel of the cable necessary for opening the buckle (17), the force of the first spring (38) being greater than the force of the second spring (44) so that the movable tube (40), and consequently the lever (35), are only displaced from the moment in which the cable head (43) comes into abutment against the movable tube (40).

8. The ski boot as claimed in claim 7, wherein said tubular housing (41) and the movable tube (40) are in the form of a circular arc and wherein the second return spring (44) is a helical spring mounted in the tubular housing around the movable tube (40) and working under compression between the cable head and the opposite end of the tubular housing (41).

9. The ski boot as claimed in claim 2, wherein the flexible bands are superposed at the rear and wherein the lockable device is constituted by a finger (52) which is movable axially and engaged under the action of a spring (53) in two holes provided in the flexible bands in the zone of superposition.

10. The ski boot as claimed in claim 2, wherein the flexible bands (23, 24) are provided with projections (54, 55; 65, 66), via which they are hooked and locked mutually, unlocking taking place by moving apart of the flexible bands.

11. The ski boot as claimed in claim 10, wherein the flexible bands are superposed and guided laterally, wherein the mutual hooking projections (54, 55) have a ramp (54*a*, 55*a*) on the side opposite their hooking face and wherein the flexible bands are kept hooked by a pressure piece (57) subjected to the action of a spring (59), this pressure piece being equipped with hooking means (56) which hold captive the flexible band (24) in contact with the pressure piece, allowing its sliding, the pressure piece furthermore being connected to a traction device which makes it possible to release the hooking projections from one another.

12. A ski boot with a shell comprising a variable-volume lower shell (1) intended to surround a foot and a heel of a skier and a shaft (3) particular on the lower shell and constituted by a front part (5) and by a rear part (31) which are articulated about a common pin (4) between a closed position and an open position and come to be applied edge to edge against one another in the closed position, the front part (5) forming a collar having at the front two superposed flaps which make possible the clamping of the shaft and at the rear an indentation (8) intended to be closed by the rear part (11), the boot being provided with at least one buckle (17) for clamping the shaft, and at least one buckle (14) for clamping the lower shell on the foot, wherein the two parts of the shaft (5,11) are connected to one another by two non-extensible flexible bands (23,24) adapted to assume a locking position and an unlocked position, the bands attached by one of their ends respectively on each side of the front part of the shaft and connected to the rear part of the shaft by a lockable device (34; 52; 54, 55; 65, 66) which allows the relative displacement of the flexible bands in the unlocked position; wherein said lockable device is constructed and arranged to lock automatically when the flexible bands are in the locking position; wherein the flexible bands (23, 24) are superposed and unlockable by a transverse displacement of at least one of the bands in relation to the other.

13. The ski boot as claimed in claim 12, wherein the flexible bands are each equipped with at least one mutual hooking projection (65, 66) which extends over only a part of the width of the flexible bands and has a ramp on the side opposite their hooking face, wherein the flexible bands are pushed against one another by a spring (72), wherein one of the flexible bands (24) is guided laterally by a fixed guide and wherein the other flexible band (23) has a longitudinal groove or slit (68), in which there is engaged a stud (69) of a crank pin (70) which is stressed under torsion by a return spring keeping the crank pin in a position corresponding to the hooking position of the projections, the rotation of the crank pin having the effect of displacing the corresponding band (23) laterally and of unhooking the bands from one another.

14. The ski boot as claimed in one of claim 1, wherein the flexible bands are situated inside the shaft of the boot.

* * * * *